US007625212B2

(12) United States Patent
Du

(10) Patent No.: US 7,625,212 B2
(45) Date of Patent: Dec. 1, 2009

(54) MAGNETICALLY COUPLED ELECTRICAL CONNECTOR

(75) Inventor: Wen-Qing Du, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/127,022

(22) Filed: May 27, 2008

(65) Prior Publication Data

US 2009/0215283 A1 Aug. 27, 2009

(30) Foreign Application Priority Data

Feb. 21, 2008 (CN) ..... 2008 1 0300366

(51) Int. Cl.
*H01R 11/30* (2006.01)
*H01R 13/60* (2006.01)

(52) U.S. Cl. ..... 439/39

(58) Field of Classification Search ..... 439/38, 439/39, 700, 607, 362, 357, 358, 350, 353
See application file for complete search history.

(56) References Cited

U.S. PATENT DOCUMENTS

| | | | | |
|---|---|---|---|---|
| 3,868,160 | A * | 2/1975 | Kersman | 439/39 |
| 5,158,473 | A * | 10/1992 | Takahashi et al. | 439/353 |
| 7,311,526 | B2 | 12/2007 | Rohrbach et al. | |
| 2008/0139005 | A1 * | 6/2008 | Guo et al. | 439/39 |

* cited by examiner

*Primary Examiner*—Javaid Nasri
(74) *Attorney, Agent, or Firm*—Frank R. Niranjan

(57) ABSTRACT

A connector includes a plug and a receptacle. The plug includes a main body, a hook, a pressing member, a plurality of conductive terminals and a first magnet. The first magnet being disposed on the main body. The main body defines a receiving cavity and a through hole therein. The hook has a base received in the receiving cavity and a curved end. The pressing member passes through the through hole. The base of the hook defines a recess therein for fitting the pressing member. The receptacle is detachably coupled to the plug. The receptacle defines a plurality of insertion holes and includes a second magnet. The plurality of insertion holes are for providing electrical connection by engaging with the plurality of conductive terminals. The second magnet is for maintaining a magnetic force repulsive to the first magnet when the first part and the second part are coupled together.

19 Claims, 4 Drawing Sheets

MAGNETICALLY COUPLED ELECTRICAL CONNECTOR

BACKGROUND

1. Field of the Invention

The present invention generally relates to connectors, and more particularly, relates to a connector for providing electrical connection between electronic devices.

2. Description of Related Art

There are a variety of electronic connectors, such as universal serial bus (USB), high definition multimedia interface (HDMI), and D-subminiature (D-SUB). These connectors are used with cables to connect electronic devices together for providing communication functionality or for power connections.

The connectors usually have a female part mounted on a printed circuit board (PCB) of the electronic device, and a male part connected to the cable and the cable may be coupled to an external electronic device, such as a monitor, a keyboard, a mouse, or a modem. The male part and the female part may engage each other for providing electrical connections between the PCB of the electronic device and the external electronic device.

Generally, when connecting the male part with the female part, a resistive force between the male part and the female part has to be overcome. For example, the resistive force may be 50 Newton (N). In operation, an external force of 70 N may be exerted to the male part for overcoming the resistive force. However, if too much force is used, the connector may be damaged.

Therefore, what is desired in the industry is to provide a connector that is capable of providing a reliable electrical connection between electrical devices that is not easily damaged.

SUMMARY

Accordingly, a connector is provided. In an exemplary embodiment, the connector includes a plug and a receptacle. The plug includes a main body, a hook, a pressing member, a plurality of conductive terminals and a first magnet. The first magnet being disposed on the main body. The main body defines a receiving cavity and a through hole therein. The hook has a base received in the receiving cavity and a curved end. The pressing member passes through the through hole. The base of the hook defines a recess therein for fitting the pressing member. The receptacle is detachably coupled to the plug. The receptacle defines a plurality of insertion holes and includes a second magnet. The plurality of insertion holes is for providing electrical connection by engaging with the plurality of conductive terminals. The second magnet is for maintaining a repulsive magnetic force to the first magnet when the first part and the second part are coupled together.

DETAILED DESCRIPTION

Reference will now be made in detail to the exemplary embodiments of the display apparatus, examples of which are illustrated in the accompanying drawings.

Figure 1:
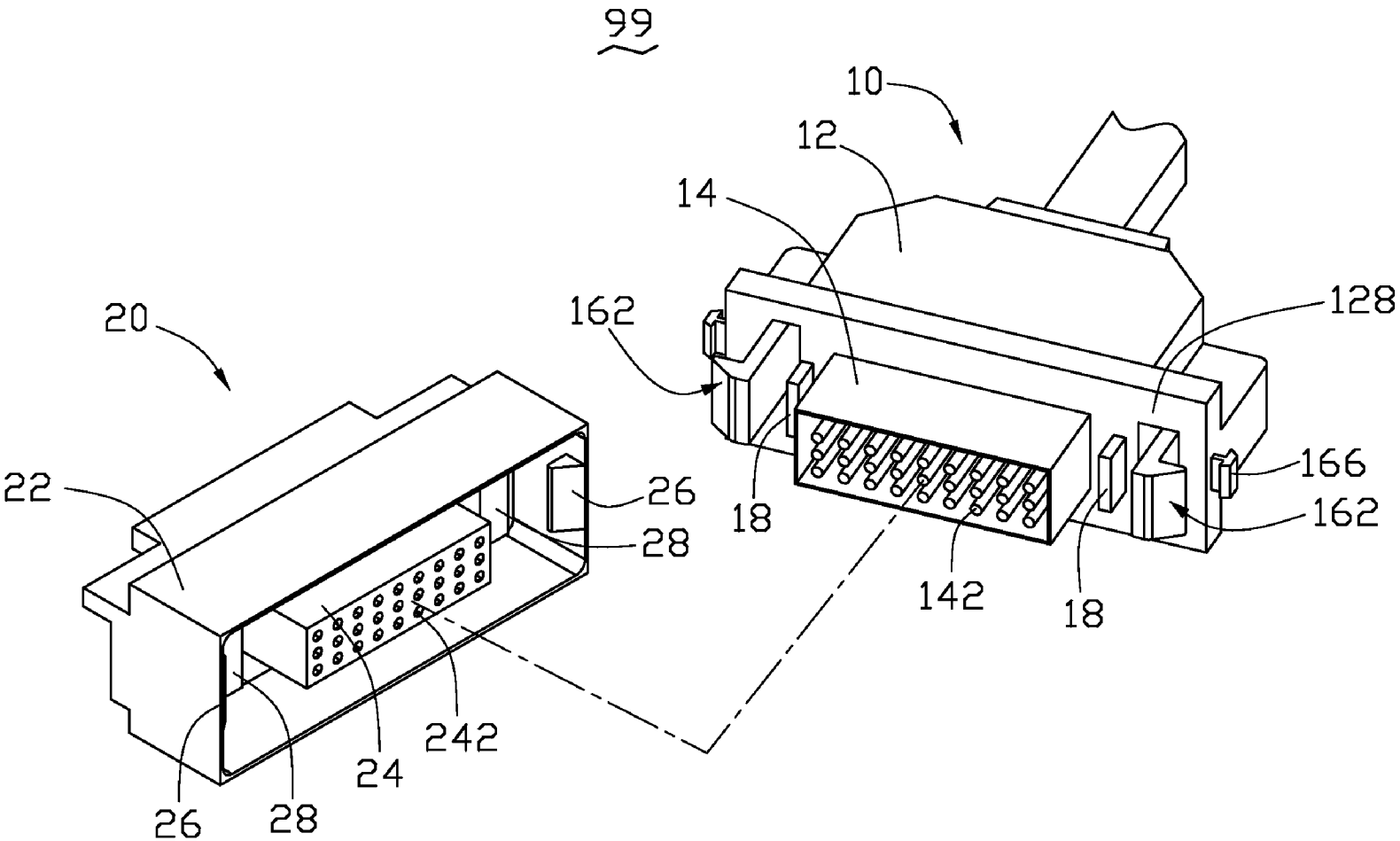
FIG. 1 is an exploded view of a connector including a plug and a receptacle in accordance with an exemplary embodiment.
Figure 2:
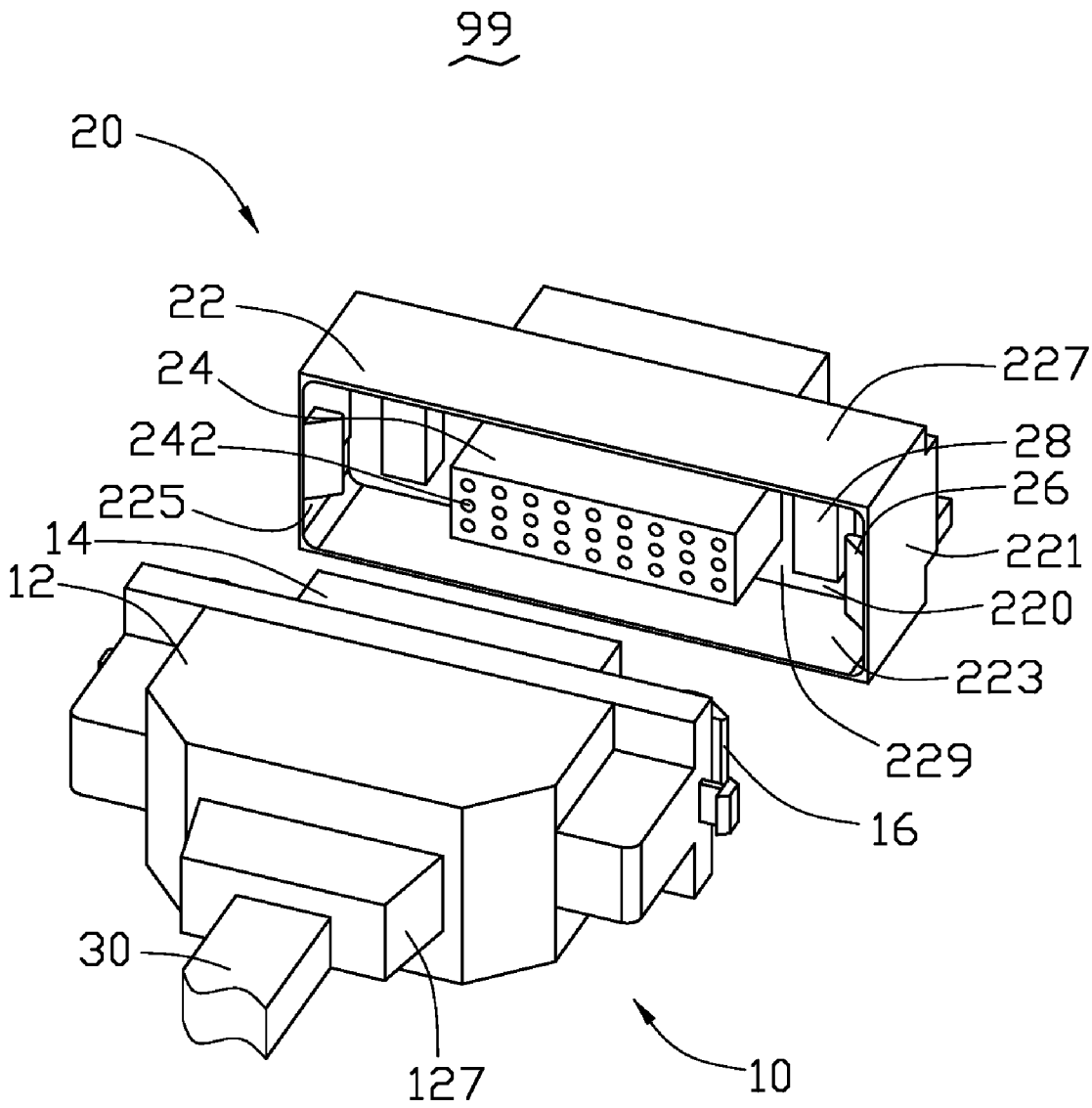
FIG. 2 is another exploded view of the connector in FIG. 1.
Figure 3:
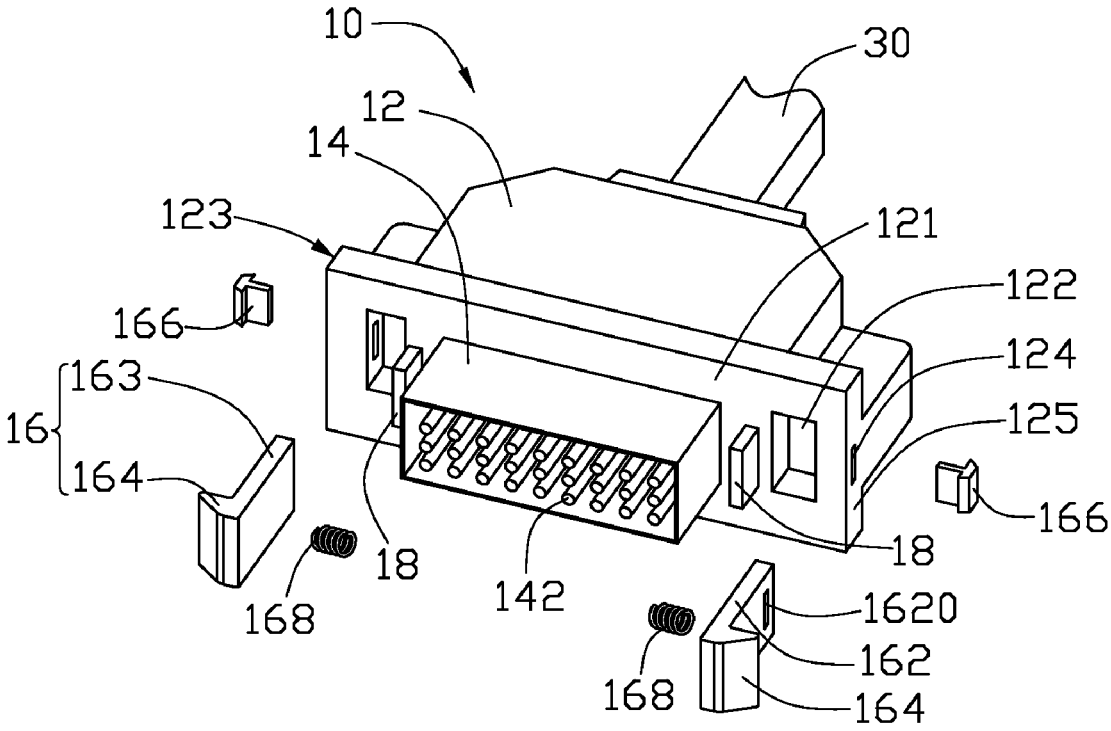
FIG. 3 is a partially exploded view of the plug in FIG. 1.

Referring to FIGS. 1-3, a connector 99 such as a video graphics array (VGA) type connector in accordance with an exemplary embodiment is provided. The connector 99 includes a first part such as a plug 10 and a second part such as a receptacle 20. The plug 10 is electrically connectable to a first electronic device (not shown) such as a monitor via a cable 30, and the receptacle 20. The receptacle 20 may be mounted to a printed circuit board (PCB) (not shown) mounted in a second electronic device (also not shown) such as a desktop computer.

Firstly, construction of the plug 10 is described below. The plug 10 includes a main body 12, and associated with the main body 12 are a shield member 14, two hooks 162, two pressing members 166, two compression springs 168, and two first magnets 18.

The main body 12 includes a rear portion 127 (see FIG. 2) and a front portion 128. The rear portion 127 is fixedly connected to the cable 30, which includes a sheath (not labeled) and metallic wires (not shown) inside the sheath. The metallic wires are electrically connected to conductive terminals 142 through the main body 12.

The front portion 128 is arranged opposite to the rear portion 127. The front portion 128 includes a front surface 121 and a pair of side surfaces 123, 125 (see FIG. 3) extending substantially perpendicular to the front surface 121. The front surface 121 defines a pair of receiving cavities 122 at two opposite edges adjacent to the side surfaces 123, 125. Each of the side surfaces 123, 125 defines a through hole 124. Each through hole 124 communicate with each corresponding receiving cavity 122 respectively.

The shield member 14 and the plurality of conductive terminals 142 are arranged at a central portion of the front surface 121 of the front portion 128. The shield member 14 and the plurality of conductive terminals 142 extend outwardly in a direction substantially perpendicular to the front surface 121.

The conductive terminals 142 are arranged in an array, and are surrounded by the shield member 14, such that the conductive terminals 12 are prevented from having unintended contact with other objects.

The two hooks 162 are arranged symmetrically relative to the shield member 14. Each of the hooks 162 is for engaging with a corresponding engaging portion 26 of the receptacle 20 for stably connecting the plug 10 and the receptacle 20.

Each hook 162 includes a base 163 and a curved end 164. The base 163 has a substantially rectangular shape, and is capable of being received in the receiving cavity 122 defined in the front portion 128. The curved end 164 is wedge-shaped, integrally formed with the base 163, and extends perpendicularly relative to the base 163. The curved end 164 is for engaging with the corresponding engaging portion 26 formed in the receptacle 20, which will be described with more details hereinafter. In addition, the base 163 is defined with a recess 1620 therein adjacent to an extremity that is opposite to the curved end 164.

Each pressing member 166 passes through the corresponding through hole 124 defined in the side surface 123. One end of the pressing member 166 fits in the recess 1620 via interference fit. It should be noted that the pressing member 166 may be fixedly attached to the base 163 by screws.

The compression spring 168 is received in the receiving cavity 122 and located beside the base 163. The compression spring 168 provides a restoring force to the hook 162, when the base 163 together with the pressing member 166 is pressed by an external force to move in a direction towards the shield member 14. The compression spring 168 exerts a resilient force to the base 163 to move in an opposite direction away from the shield member 14, when the pressing member 166 is released from the external force.

The two first magnets 18 are mounted on the front surface 121 of the front portion 128, and arranged beside the shield member 14. When the two bases 163 are fitted in the receiving cavity 122, the two first magnets 18 are located between the shield member 14 and the corresponding base 163.

Secondly, construction of the receptacle 20 is described below. The receptacle 20 includes a case 22, a connection member 24, two engaging portions 26, and two second magnets 28. The case 22 includes a bottom plate 220 and four sidewalls 221, 223, 225, 227. The bottom plate 220 may be mounted to a printed circuit board (PCB). The case 22 is constructed by sequentially connecting the four sidewalls 221, 223, 225, 227 to the bottom plate 220, thereby defining an accommodating space 229.

The connection member 24 is disposed in the accommodating space 229, and extends from the bottom plate 220 in the accommodating space 229. The connection member 24 is defined with a plurality of insertion holes 240 corresponding to the conductive terminals 142.

The two engaging portions 26 are wedge-shaped, and protrude internally in the accommodating space 229 from the two sidewalls 221, 225 respectively. The two engaging portions 26 are capable of engaging with corresponding curved ends 164 of the hooks 162 for coupling the plug 10 and the receptacle 20 together.

The two second magnets 28 are attached to the bottom plate 227, have the same polarity as the two first magnets 18, and located beside the connection member 24. When the plug 10 is inserted in the receptacle 20, the two second magnets 28 and the two first magnets 18 will repulse each other. As such, the conductive terminals 142 of the plug 10 are prevented from being inserted into the corresponding insertion holes 142 with excessive force. It should be noted that the two second magnets 28 and the first two magnets 18 may be a permanent type or an electromagnetic type.

Hereinafter, a process of connecting and disconnecting the plug 10 with the receptacle 20 will be described.

In connecting, the plug 10 is brought into alignment with the receptacle 20. The shield member 14 is made to contact the connecting member 24. The conductive terminals 142 are aligned with the corresponding insertion holes 242. The curved ends 164 are brought into contact with the corresponding engaging portions 26. At this point, the magnetic repulsive forces of the two first magnets 18 and the two second magnets 28 are strong enough to reduce or rebuff excessive force applied in pressing the plug 10 and the receptacle 20 together.

By further pressing of the plug 10 towards the receptacle 20, the curved ends 164 are biased to move toward the shield member 14 and the compression springs 18 are compressed to maintain restoring force accordingly. At the same time, the conductive terminals 142 engages with the corresponding insertion holes 242. As the two first magnets 18 and the corresponding two second magnets 28 are brought closer the magnetic repulsive forces increases, and the conductive terminals 142 are prevented from being inserted into the corresponding insertion holes 242 with excessive force.

Figure 4:
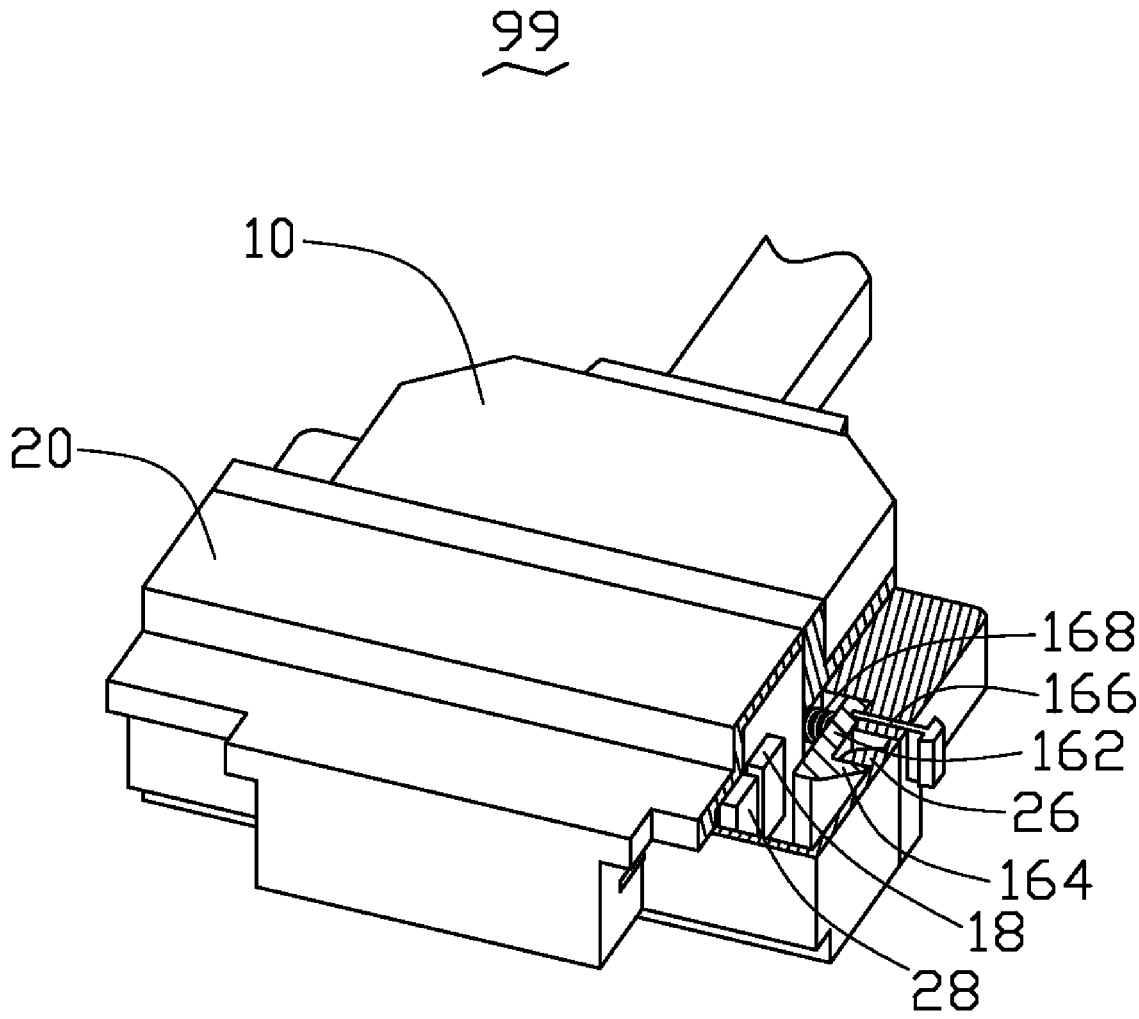
FIG. 4 is a partially cutaway view of the connector in FIG. 1 assembled.

By pressing further still, the curved ends 164 engage with the corresponding engaging portions 26, and the hooks 162 are forced by the resilient force of the compression springs 18 to move away from the shield member 14, such that the plug 10 and the receptacle 20 are fixedly coupled together as shown in FIG. 4. At the same time, the magnetic repulsive forces provide a more reliable engagement relationship between the hooks 162 and the corresponding engagement portions 26.

In disconnecting the connector 99, the pressing members 166 are pressed to move in unison with each other. The pressing members 166 pushes the corresponding hooks 162 to move toward the shield member 14, and the compression springs 18 are caused to maintain restoring force accordingly.

By further pressing the pressing member 166, the curved ends 164 disengages from the corresponding engaging portions 26. Because of the magnetic repulsive forces between the first two magnets 18 and the two second magnets 28, the conductive terminals 142 are easily pulled out from the insertion holes 242 after the curved ends 164 disengage from the engaging portions 26. After the conductive terminals 142 are pulled out from the insertion holes 242 of the connection member 24, the pressing members 166 are released. Thereafter, the hooks 162 are biased to move away from the shield member 14 by the resilient force maintained in the corresponding compression springs 18. As a result, the disconnecting process is completed.

As described above, magnets are provided in the plug 10 and the receptacle 20 of the connector 99 respectively. When the plug 10 are pushed to couple with the receptacle 20, repulsive magnetic forces are exerted in a direction opposite to that of the pressing movement, such that the plug 10 is prevented from being inserted into the receptacle with excessive force. As such, the electrical connection between the plug 10 and the receptacle 20 is reliably protected. Moreover, when the plug 10 is separated from the receptacle 20, the magnetic repulsive force makes the pulling movement more easily.

It will be understood that, although the terms first, second, etc. may be used herein to describe various elements and components, these elements and components should not be limited by these terms. These terms are only used to distinguish one element, component from another element or component. Thus, a first element, component discussed above could be termed a second element, component without departing from the teachings of the present invention.

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A connector, comprising:

a first part comprising a main body, a pressing member, a plurality of conductive terminals, a locking member and a first magnet, the first magnet being disposed on the main body, the main body defining a receiving cavity and a through hole therein, the locking member having a base received in the receiving cavity and a curved end, and the pressing member passing through the through hole, the base of the locking member defining a recess therein for fitting the pressing member; and a second part detachably coupled to the first part, the second part defining a plurality of insertion holes for providing electrical connection by engaging with the plurality of conductive terminals, and comprising a second magnet disposed to be repulsive to the first magnet and an engaging portion being engaged with the locking member for locking the first part to the second part.

2. The connector of claim 1, wherein the first part further comprises a shield member, the shield member extends in a same direction with the plurality of conductive terminals from the main body, and the plurality of conductive terminals are received in the shield member.

3. The connector of claim 1, wherein the first part further comprises a compression spring, the compression spring is received in the receiving cavity and disposed beside the base of the locking member, the compression spring is for maintaining a restoring force when the locking member is pressed by the pressing member.

4. The connector of claim 1, wherein the first part further comprises another first magnet, the two first magnets are disposed symmetrically beside the plurality of conductive terminals.

5. The connector of claim 1, wherein the second part further comprises a case defining an accommodating space, and a connection portion received in the accommodating space, the plurality of insertion holes are defined in the connection portion.

6. The connector of claim 1, wherein the second part including a case, the engaging portion is wedge-shaped and protrudes internally from the case for engaging with the curved end of the locking member.

7. The connector of claim 1, wherein the second part further comprises another second magnet, the two second magnets are disposed symmetrically relative to the plurality of insertion holes.

8. A connector, comprising:

a plug comprising a main body, a hook, a pressing member, a plurality of conductive terminals and a pair of first magnets, the pair of first magnets being disposed symmetrically relative to the plurality of conductive terminals, the pair of first magnets are disposed on the main body, the main body defining a receiving cavity and a through hole therein, the hook having a base received in the receiving cavity and a curved end, the pressing member passing through the through hole, the base of the hook defining a recess therein for fitting the pressing member; and a receptacle defining a plurality of insertion holes and comprising a pair of second magnets, the pair of second magnets being arranged corresponding to the pair of first magnets for producing magnetic force to resist a pressing movement for inserting the plurality of conductive terminals into the corresponding plurality of insertion holes, the magnetic force for facilitating a pulling movement for escaping the plurality of conductive terminals from the corresponding plurality of insertion holes.

9. The connector of claim 8, wherein the plurality of conductive terminals extend from the main body.

10. The connector of claim 8, wherein the plug further comprises a shield member, the shield member extends in a same direction with the plurality of conductive terminals from the main body, and the plurality of conductive terminals are received in the shield member.

11. The connector of claim 8, wherein the plug farther comprises a compression spring, the compression spring is received in the receiving cavity and disposed beside the base of the hook, the compression spring is for maintaining a restoring force when the hook is pressed by the pressing member to move approaching the plurality of conductive terminals.

12. The connector of claim 8, wherein the receptacle further comprises a case defining an accommodating space, and a connection portion received in the accommodating space, the plurality of insertion holes are defined in the connection portion.

13. The connector of claim 8, wherein the receptacle further comprises a case and an engaging portion, the engaging portion is wedge-shaped and protrudes internally from the case for engaging with the curved end of the hook.

14. A connector, comprising:

a first part comprising a main body, a hook, a pressing member, and a plurality of conductive terminals, the main body defining a receiving cavity and a through hole therein, the hook having a base received in the receiving cavity and a curved end, the pressing member passing through the through hole, the base of the hook defining a recess therein for fining the pressing member; and a second part detachably coupled to the first part, the second part defining a plurality of insertion holes engaging with the plurality of conductive terminals.

15. The connector of claim 14, wherein the first part further comprises a compression spring, the compression spring is received in the receiving cavity, disposed beside the base of the hook, and secured to the base of the hook.

16. The connector of claim 14, wherein the second part further comprises a case and an engaging portion, the engaging portion protrudes internally from the case and engages with the curved end of the hook.

17. The connector of claim 14, wherein the first part further comprises a first magnet disposed on the main body; and the second part further comprises a second magnet disposed to be repulsive to the first magnet, the second magnet is attached to a bottom plate of the second part.

18. The connector of claim 17, wherein the first part further comprises a third magnet, the first magnet and the third magnet are disposed symmetrically beside the plurality of conductive terminals; and the second part further comprises a fourth magnet, the second magnet and the fourth magnet are disposed symmetrically beside the plurality of insertion holes.

19. The connector of claim 14, wherein the second part further comprises a case defining an accommodating space, and a connection portion received in the accommodating space, the plurality of insertion holes are defined in the connection portion.

* * * * *